US006434869B1

(12) United States Patent
Ngo

(10) Patent No.: US 6,434,869 B1
(45) Date of Patent: Aug. 20, 2002

(54) DECORATION SYSTEM

(76) Inventor: Dat Ngo, RD4 Box 102, Huntingdon, PA (US) 16652

( * ) Notice: Subject to any disclaimer, the term of this patent is extended or adjusted under 35 U.S.C. 154(b) by 0 days.

(21) Appl. No.: 09/550,003

(22) Filed: Apr. 14, 2000

(51) Int. Cl.[7] ..... G09F 23/00; E04F 13/00; A45D 42/14

(52) U.S. Cl. ..... 40/607; 40/586; 248/674

(58) Field of Search ..... 40/607, 586, 645, 40/538, 798, 799; 248/674, 675, 472, 469

(56) References Cited

U.S. PATENT DOCUMENTS 2,846,797 A * 6/1958 Boyd ..... 40/30
3,969,837 A * 7/1976 Kresse ..... 40/126
4,638,618 A * 1/1987 Iesake et al. ..... 52/509
4,791,740 A * 12/1988 Ferrari ..... 40/124
5,250,331 A * 10/1993 Grefalda ..... 428/11
5,369,902 A * 12/1994 Minster ..... 40/645
5,897,416 A * 4/1999 Barrows ..... 446/147
6,158,702 A * 12/2000 Kump ..... 248/206.2
6,206,074 B1 * 3/2001 Liu ..... 160/38

* cited by examiner

*Primary Examiner*—Tan Nguyen
*Assistant Examiner*—Dalena Tran
(74) *Attorney, Agent, or Firm*—John J. Elnitski, Jr

(57) ABSTRACT

The present invention is a decoration system. It can be used to decorate an outside of a building or inside of a building. It can be used for a temporary decoration or as a permanent display. Examples of uses are Happy Birthday displays, congratulations displays, birth announcement displays or permanent decoration displays. The decoration system includes decoration panels, rod mounting brackets, rods, announcement plates and fasteners.

20 Claims, 5 Drawing Sheets

DECORATION SYSTEM

BACKGROUND

The present invention relates to a decoration system. There are many decorations currently available. These decorations are usually designed for one specific purpose, for example a birth announcement. What is needed is a system that is versatile and can be can for different occasions or different looks.

It is an object of the present invention to provide a decoration system which can be changed in appearance and design by the user to fit different occasions and reasons for decorating.

SUMMARY OF THE INVENTION

The present invention is a decoration system. It can be used to decorate an outside of a building or inside of a building. It can be used for a temporary decoration or as a permanent display. Examples of uses are Happy Birthday displays, congratulations displays, birth announcement displays or permanent decoration displays. The decoration system includes decoration panels, rod mounting brackets, rods, announcement plates and fasteners.

DETAILED DESCRIPTION OF THE INVENTION

The present invention is a decoration system, as shown in FIGS. 1–6. It can be used to decorate an outside of a building or inside of a building. It can be used for a temporary decoration or as a permanent display. Examples of uses are Happy Birthday displays, congratulations displays, birth announcement displays or permanent decoration displays. The decoration system includes decoration panels 10, rod mounting brackets 12, rods 14, announcement plates 16 and fasteners.

Figure 1:
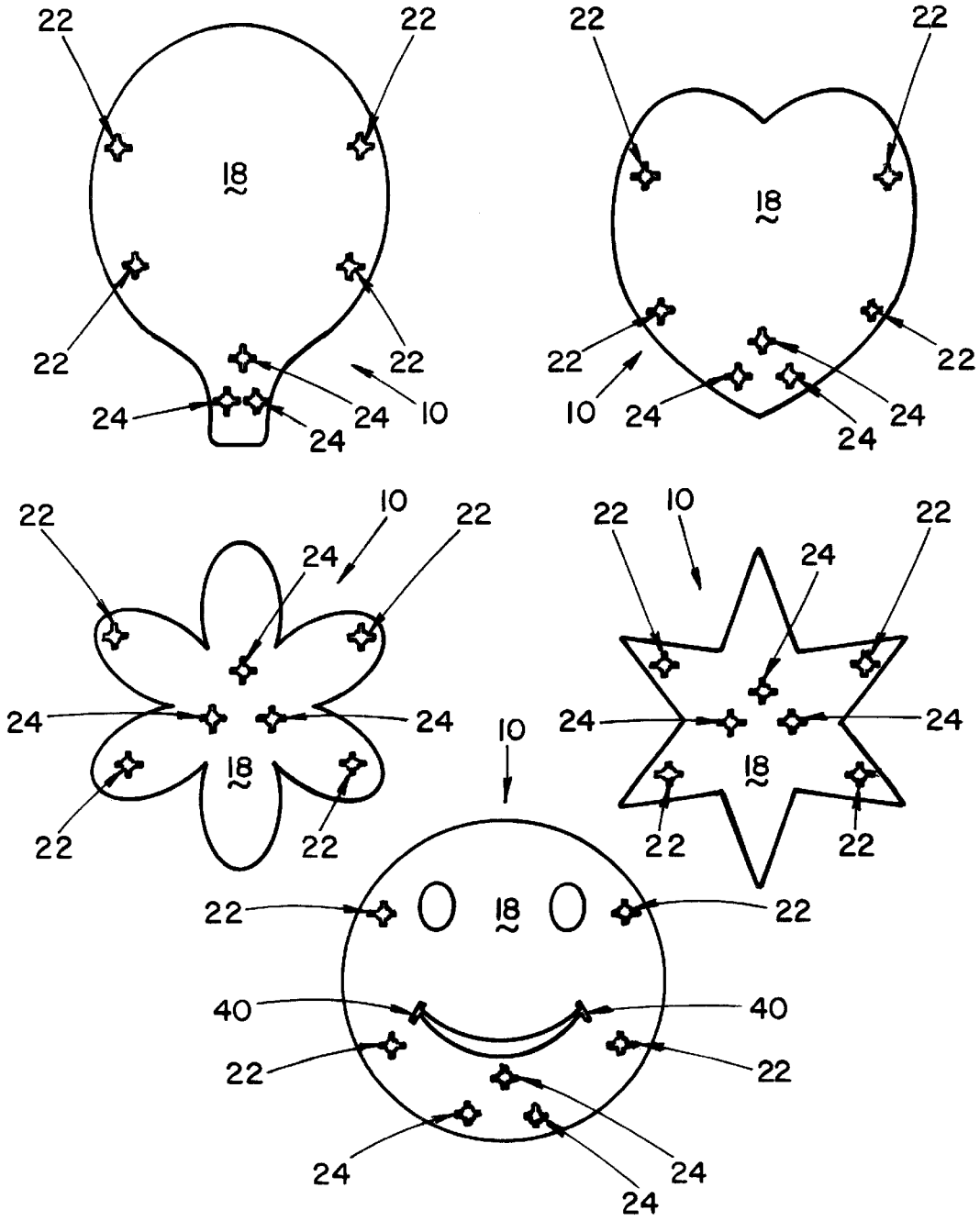
FIG. 1 is a front view of decoration panels according to the present invention.
Figure 2:
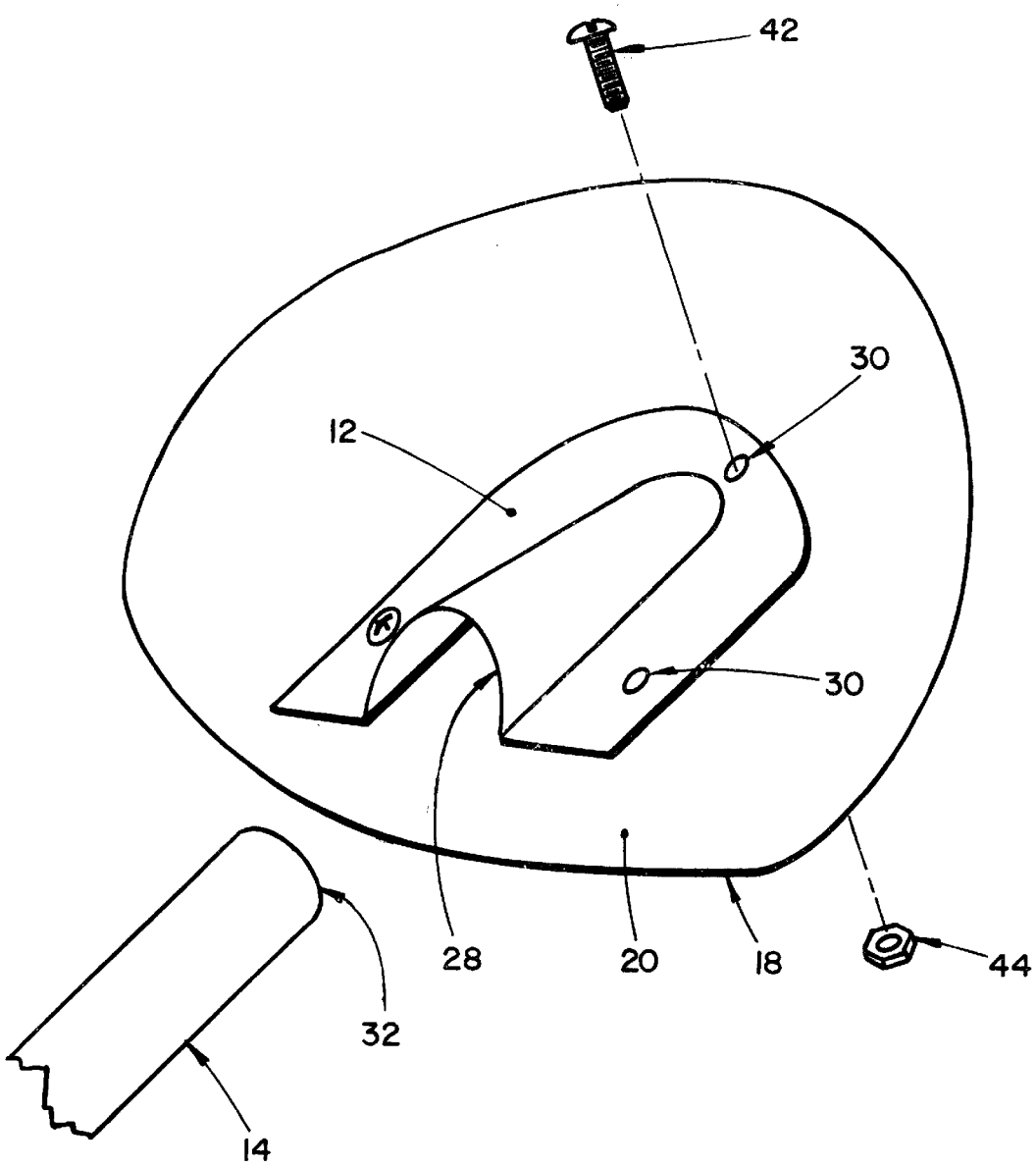
FIG. 2 is a perspective rear view of a decoration panel and rod according to the present invention.
Figure 3:
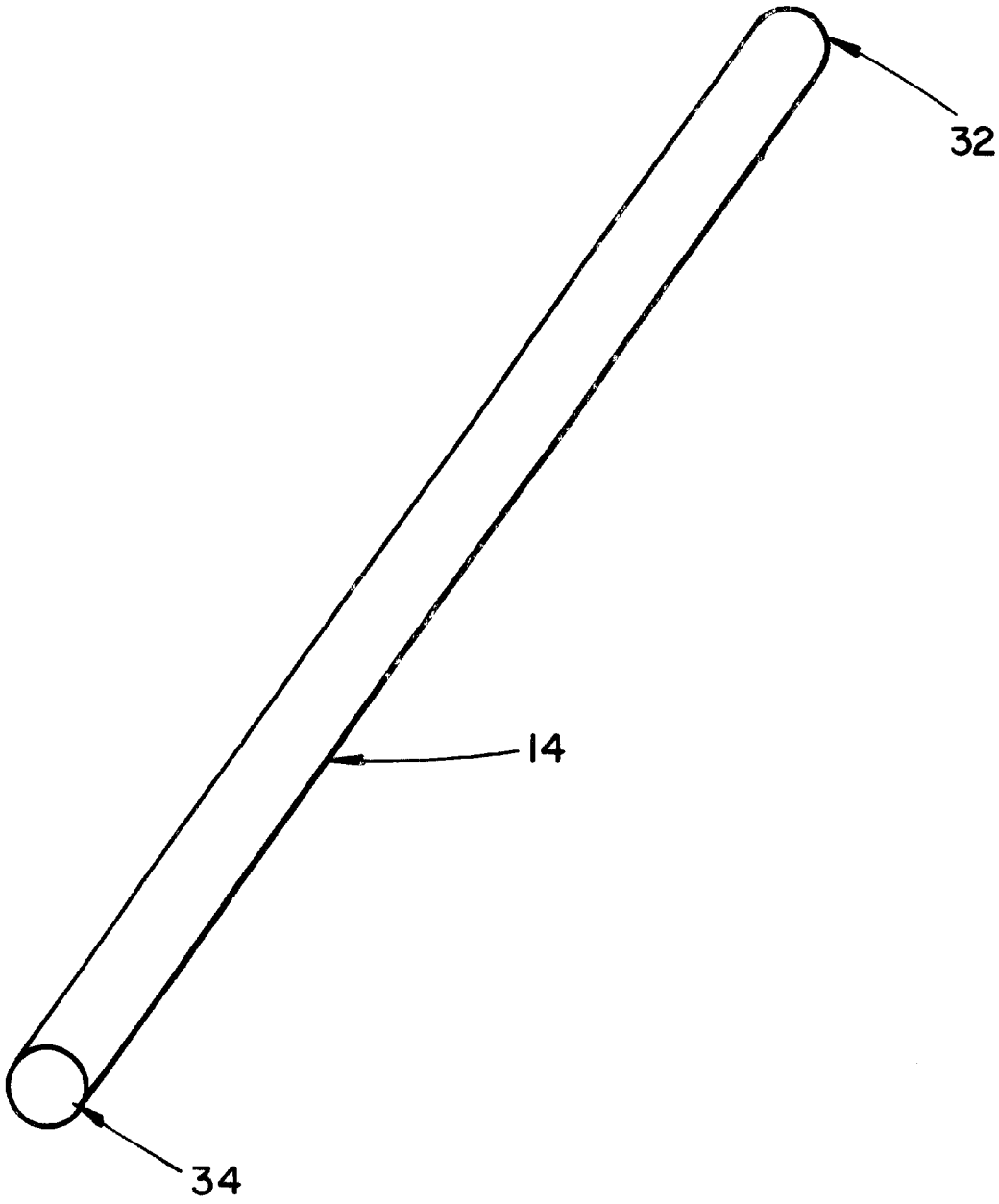
FIG. 3 is a perspective view of a rod according to the present invention.
Figure 4:
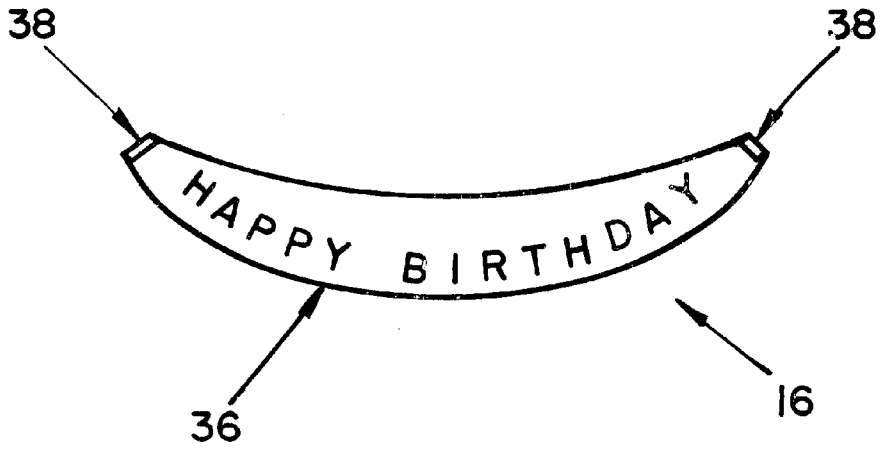
FIG. 4 is a front view of a announcement plate according to the present invention.
Figure 5:
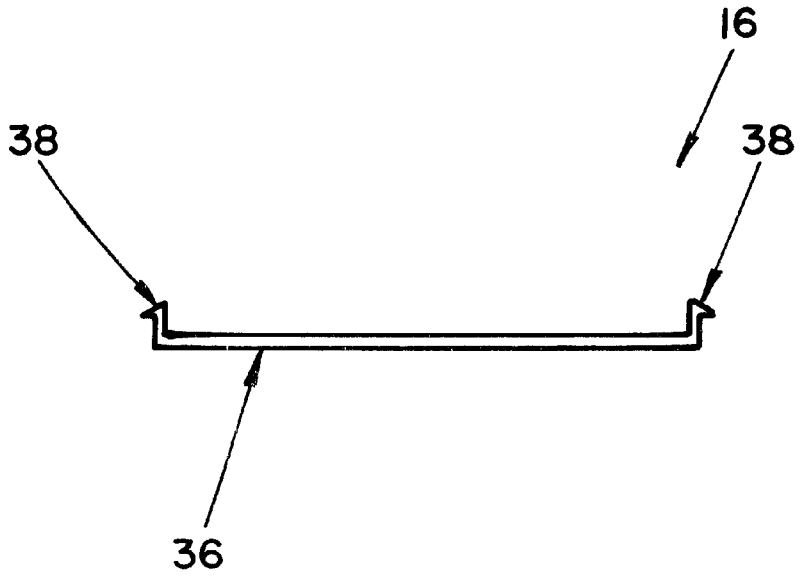
FIG. 5 is a top view of a announcement plate according to the present invention.

The decoration panels 10 are shown in shapes of a balloon, heart, flower, happy face and a star, as shown in FIG. 1. The decoration panels 10 are one dimensional shapes having a front 18, rear 20, fastener holes 22 and mounting bracket holes 24. The rod mounting brackets 12 have a flat face with rounded bulge 28 near the center of the flat face, as shown in FIG. 2. Face fastener holes 30 are located on the flat face and the face fastener holes 30 align and mate with the mounting bracket holes 24. The rods 14 have a top end 32 and a bottom end 34, as shown in FIG. 3. The announcement plate 16 is a flat plate 36 with tabs 38 extending from the flat plate 36 at each end, as shown in FIGS. 4–5. The happy face is shown with tab slots 40 to receive the tabs 38 of the announcement plate 16, as shown in FIG. 1. The fasteners shown are machine screws 42 and nuts 44, as shown in FIG. 2.

Figure 6:
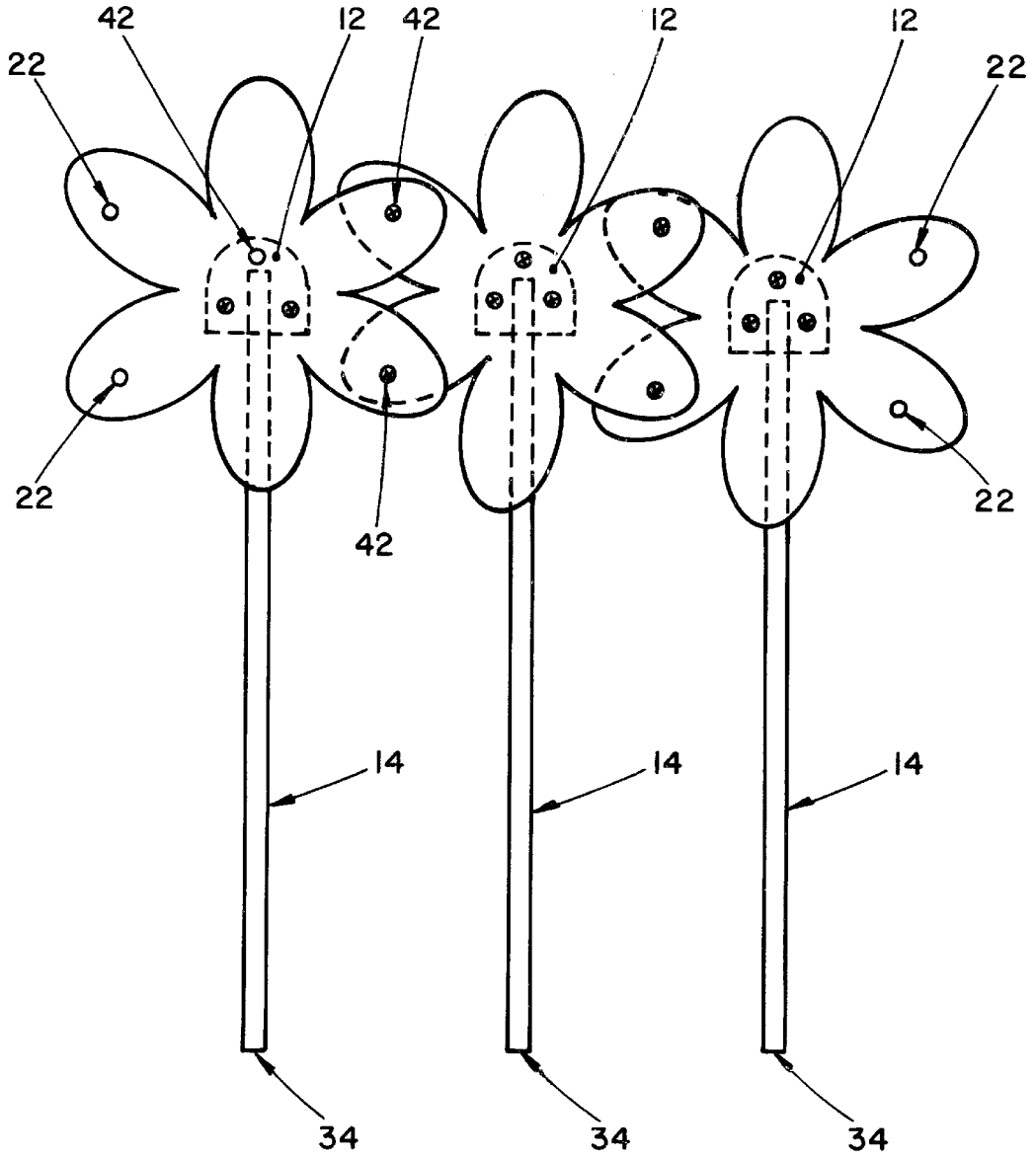
FIG. 6 is a front view of an assembly of decoration panels according to the present invention.

The decoration system is assembled as follows. The rod mounting bracket 12 is mounted to the rear 20 of the decoration panel 10 by inserting the machine screws 42 into the mounting bracket holes 24 from the front 18 of the decoration panel 10 and on through the mating face fastener holes 30 of the rod mounting bracket 12. The machine screws 42 and hence the rod mounting bracket 12 is secured to the decoration panel 10 by screwing on the nuts 44 onto the machine screws 42. The nuts 44 are not fully tighten at this point, until the top end 32 of one of the rods 14 is inserted between the rounded bulge 28 and the rear 20 of the decoration panel 10. Once the top end 32 of the rod 14 is inserted between the rounded bulge 28 and the decoration panel 10, the nuts 44 are tighten, whereby the rod mounting bracket 12 and the rod 14 are secured to the decoration panel 10. The bottom end 34 of the rod 14 can be inserted into the ground or other type of surface, such that the rod 14 supports the decoration panel 10. The fastener holes 22 in each decoration panel 10 allow two or more decoration panels 10 to be fastened together, as shown in FIG. 6. The decoration panels 10 are arranged in FIG. 6, such that decoration panels 10 partially overlap each other at their edges, so the fastener holes 22 of one decoration panel 10 aligns with the fastener holes 22 other decoration panel 10. The machine screws 42 and nuts 44 are used to fasten decoration panels 10 together. When decoration panels 10 are combined, the rods 14 of each decoration panel 10 can be bunched together at the bottom ends 34 of the rods 14 for insertion into the ground, similar to a bouquet of flowers, as shown in FIG. 6. The rods 14 can also be attached to the side of a structure. The happy face decoration panel 10 is shown with a tab slot at each end of the smile 48. The tab slots 40 are for receiving the tabs 38 of the announcement plate 16. Therefore, the announcement plate 16 can be snapped onto the decoration panel 10 with an announcement and removed to insert another announcement plate 16 having a different announcement.

The present invention allows for different designs to meet all types of occasions. A number of flowers decoration panels 10 can be combined to form a bouquet of flowers. The shapes shown and other shapes not shown can be combined to from a decoration for a specific occasion, then disassembled to make a different combination for a different occasion. The announcement plate 16 can be of different shapes other than a smile and used for birthday, wedding, birth or other type of announcement.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A decoration system comprising:

a decoration panel having mounting bracket holes, a front and a rear;

a rod mounting bracket to be mounted to said rear of said decoration panel, said rod mounting bracket having a flat face, a bulge near a center of said flat face and face fastener holes located on said flat face that align and mate with said mounting bracket holes; and fasteners to fasten said rod mounting bracket.

2. The decoration system of claim 1, further including a rod having a top end and a bottom end, said top end inserted and secured between said rear of said decoration panel and said bulge of said rod mounting bracket.

3. The decoration system of claim 1, further including fastener holes in said decoration panel and including at least one more decoration panel with said fastener holes, said fastener holes aligned such that that when said decoration panels partially overlap each other, the fastener holes of one decoration panel aligns with the fastener holes other decoration panel.

4. The decoration system of claim 1, further including an announcement plate having a tab at each end and wherein said decoration panel further includes tab slots to receive said tabs and secure said announcement plate to said decoration panel.

5. The decoration system of claim 1, wherein said decoration panel is in a shape of a flower.

6. The decoration system of claim 1, wherein said decoration panel is in a shape of a balloon.

7. The decoration system of claim 1, wherein said decoration panel is in a shape of a star.

8. The decoration system of claim 1, wherein said decoration panel is in a shape of a heart.

9. The decoration system of claim 1, wherein said decoration panel is in a shape of a happy face.

10. The decoration system of claim 9, further including an announcement plate having a tab at each end and wherein said decoration panel further includes tab slots to receive said tabs and secure said announcement plate to said decoration panel and wherein said announcement plate forms a smile of said happy face.

11. A decoration system comprising:

a decoration panel having mounting bracket holes, a front and a rear;

a rod mounting bracket to be mounted to said rear of said decoration panel, said rod mounting bracket having a flat face, a bulge near a center of said flat face and face fastener holes located on said flat face that align and mate with said mounting bracket holes;

fasteners to fasten said rod mounting bracket; and a rod having a top end and a bottom end, said top end inserted said rear of said decoration panel and said bulge of said rod mounting bracket.

12. The decoration system of claim 11, further including fastener holes in said decoration panel and including at least one more decoration panel with said fastener holes, said fastener holes aligned such that that when said decoration panels partially overlap each other, the fastener holes of one decoration panel aligns with the fastener holes other decoration panel.

13. The decoration system of claim 11, further including an announcement plate having a tab at each end and wherein said decoration panel further includes tab slots to receive said tabs and secure said announcement plate to said decoration panel.

14. The decoration system of claim 12, further including an announcement plate having a tab at each end and wherein said decoration panel further includes tab slots to receive said tabs and secure said announcement plate to said decoration panel.

15. The decoration system of claim 12, wherein said decoration panel is in a shape of a flower.

16. The decoration system of claim 12, wherein said decoration panel is in a shape of a balloon.

17. The decoration system of claim 12, wherein said decoration panel is in a shape of a star.

18. The decoration system of claim 12, wherein said decoration panel is in a shape of a heart.

19. The decoration system of claim 12, wherein said decoration panel is in a shape of a happy face.

20. The decoration system of claim 19, further including an announcement plate having a tab at each end and wherein said decoration panel further includes tab slots to receive said tabs and secure said announcement plate to said decoration panel and wherein said announcement plate forms a smile of said happy face.

* * * * *